US005611112A

United States Patent [19]

Röck et al.

[11] Patent Number: 5,611,112

[45] Date of Patent: Mar. 18, 1997

[54] MOUNTING PLATE ASSEMBLY FOR A HINGE FOR MOUNTING A DOOR ON A FRAME OF AN ARTICLE OF FURNITURE

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 523,915

[22] Filed: Sep. 6, 1995

[30] Foreign Application Priority Data

Sep. 6, 1994 [AT] Austria ..... 1705/94

[51] Int. Cl.[6] ..... E05D 7/04

[52] U.S. Cl. ..... 16/237; 16/258; 16/382

[58] Field of Search ..... 16/382, 243, 244, 16/245, 246, 247, 248, 235, 236, 237, 238, 257, 258, 270, DIG. 43

[56] References Cited

U.S. PATENT DOCUMENTS

| | | | |
|---|---|---|---|
| 4,554,706 | 11/1985 | Röck et al. . | |
| 4,691,408 | 9/1987 | Rock et al. | 16/382 |
| 4,750,238 | 6/1988 | Röck et al. . | |
| 4,823,436 | 4/1989 | Salice | 16/382 |
| 4,850,080 | 7/1989 | Rock et al. | 16/270 |
| 5,022,116 | 6/1991 | Salice | 16/258 |
| 5,099,547 | 3/1992 | Salice | 16/239 |
| 5,224,242 | 7/1993 | Marjanovic | 16/258 |

FOREIGN PATENT DOCUMENTS 366464 4/1982 Austria .

*Primary Examiner*—Chuck Y. Mah

*Attorney, Agent, or Firm*—Wenderoth, Lind & Ponack

[57] ABSTRACT

A hinge mounting plate assembly enables mounting on a frame of an article of furniture a door of the article of furniture. The assembly includes a hinge arm which is pivotally mounted to a hinge casing and a mounting plate which is mountable on the frame and securable thereto by a screw. The hinge casing is insertable into a hole in the door. The hinge arm is mounted on the mounting plate by two intermediate members. A first intermediate member is mounted on the mounting plate for longitudinal movement in a horizontal direction in the plane of the closed door. The hinge arm is mounted on a second intermediate member for longitudinal movement in a horizontal direction perpendicular to the plane of the closed door. Clamping screws are provided for clamping the first intermediate member to the mounting plate and the second intermediate member to the hinge arm. Such movements being permitted upon loosening of the clamping screws. The two intermediate members are interlockable with each other.

11 Claims, 3 Drawing Sheets

MOUNTING PLATE ASSEMBLY FOR A HINGE FOR MOUNTING A DOOR ON A FRAME OF AN ARTICLE OF FURNITURE

BACKGROUND OF THE INVENTION

The present invention relates to a mounting plate assembly of a hinge for mounting on a frame of an article of furniture a door of the article of furniture, such assembly including a hinge arm which is pivotally mounted to a hinge casing that is insertable into a hole in the door, and a mounting plate which is mountable on the frame and securable thereon by a screw.

In modern furniture constructions so-called door frames are used, such frames carrying the hinges for the door, and the actual side walls of the furniture body are made of a weaker material. This has the advantages that the total cost of the piece of furniture can be reduced because the side walls may be extremely thin, and the sloe walls can be made of material of better quality and more attractive outward appearance without increasing the cost of furniture when compared with conventionally manufactured pieces of furniture.

It is difficult to fix a relatively heavy door to a narrow frame in such a way that even after a period of time no lowering or tilting of the doors occurs. Therefore, special hinges have been developed which are used for mounting a door to such a frame. An example of such a tinge is described in U.S. Pat. No. 4,554,706.

In furniture wherein hinges are mounted on a thicker side wall of a piece of furniture, hinges have been developed with which the hinge arm can be mounted on the mounting plate and locked thereon without the use of a tool by simply placing the hinge arm onto the mounting plate, whereby the hinge arm is secured to the mounting plate by a snap-on action. This technique greatly facilitates the mounting of the door on the piece of furniture. An example for such a hinge is described in U.S. Pat. No. 4,750,238.

SUMMARY OF THE INVENTION

It is the object of the invention to provide an assembly of the above type which can be used for mounting a hinge arm on a frame of a piece of furniture, whereby the hinge arm can be snapped onto the mounting plate without the use of a tool and be locked to such mounting plate. If adjustment of the position of the hinge arm with respect to the mounting plate proves to be necessary, such adjustment should be possible.

According to the invention, this object is achieved by the hinge arm being mounted on the mounting plate by means of two intermediate members. One of the intermediate members is mounted on the mounting plate for longitudinal movement in a horizontal direction in the plane of the closed door. The hinge arm is mounted on the other intermediate member for longitudinal movement in a horizontal direction perpendicular to the plane of the closed door. Such movements are permitted upon loosening of respective clamping screws. The two intermediate members are interlockable with each other. With a hinge according to the invention, the mounting plate is screwed to the furniture frame. The hinge arm is mounted by means of the hinge axle to the hinge casing that is secured to the door. When mounting the door to the piece of furniture, hinge arms thereof are secured on respective mounting plates by means of a snap lock action.

BRIEF DESCRIPTION OF THE DRAWINGS

In the following descriptions an embodiment of the invention will be described in more detail with reference to the accompanying drawings in which.

DETAILED DESCRIPTION OF THE INVENTION

A hinge casing 3 is mounted in a bore of a door 1. The hinge casing 3 and a hinge arm 5 are connected by means of a hinge axle 16.

Figure 4:
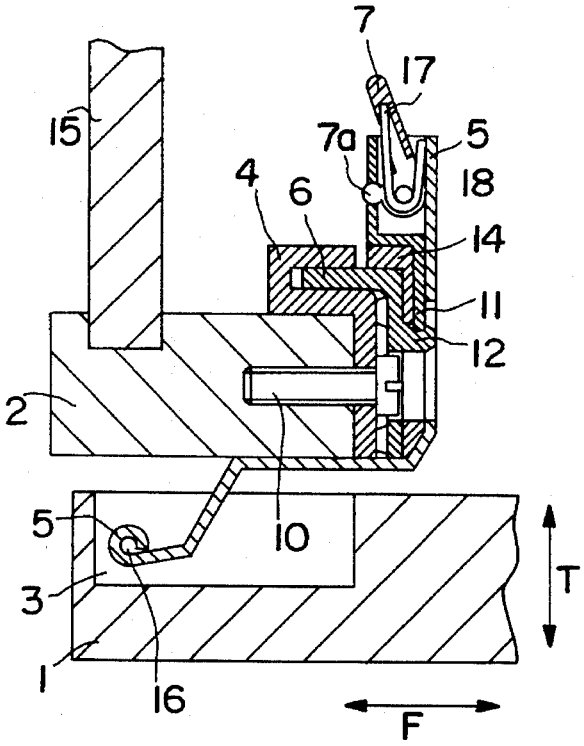
FIG. 4 is a sectional view along line IV—IV of FIG. 1.
Figure 6:
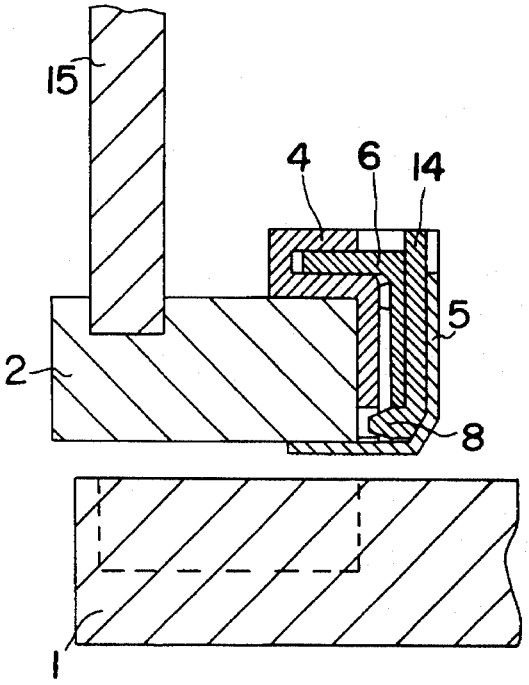
FIG. 6 is a sectional view along line VI—VI of FIG. 1.

A side wall 15 of a piece of furniture is connected at a front thereof to a frame 2. The frame 2 supports a mounting plate 4 of the hinge. The mounting plate 4 is connected to the frame 2 by means of a screw 10. The clamping screw 10 extends through a vertically elongated slot 19 in the mounting plate 4 so that the position of the mounting plate 4 can be adjusted with respect to the frame 2 in the direction of the height of the piece of furniture. A first intermediate member 6 is adjustably mounted on the mounting plate 4 by a screw 13 extending through a horizontally elongated slot **13*a* in intermediate member 6. By means of the intermediate member 6 the position of the hinge arm 5 and the door 1 can be adjusted horizontally in the plane of the closed door 1. This adjustment possibility is shown in FIG. 4** by means of a double arrow F.

Hinge arm 5 is attached to a second intermediate member 14 by screw 9 extending through slot 20 in hinge arm 5. If the clamping screw 9 is loosened, the hinge arm 5 can be moved longitudinally over the length of the slot 20 in the direction of the depth of the piece of furniture as indicated by the double arrow T in FIG. 4. By tightening the clamping screw 9, the hinge arm 5 is locked on the intermediate member 14 with respect to the depth of the piece of furniture.

Figure 8:
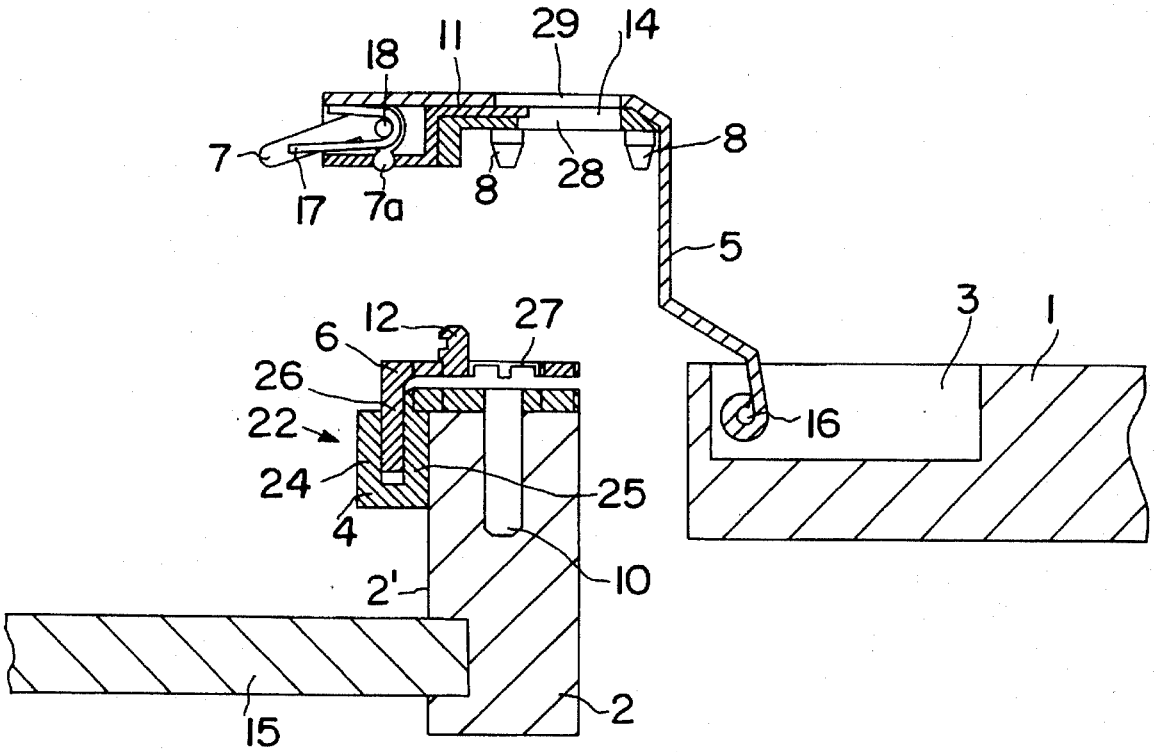
FIG. 8 is a sectional view in the same plane, whereby the hinge arm is shown apart from the mounting plate.
Figure 7:
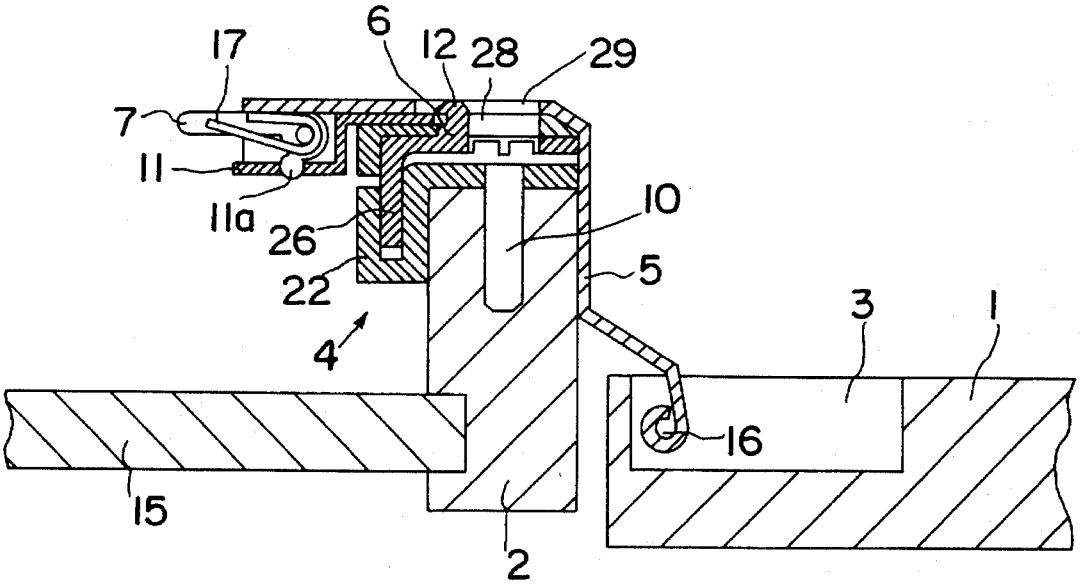
FIG. 7 is the same sectional view as FIG. 4, but whereby a slide is in an unlocked position.

A slide 11 is positioned between the intermediate member 14 and the hinge arm 5. The slide 11 is held in guiding means of the intermediate member 14 and is moveable by means of a pivot lever 7. The pivot lever 7 is provided with a protrusion **7*a* which protrudes into a corresponding hole 11*a* in the slide 11. The pivot lever 7 is mounted on an axle 18 and is acted upon by a spring 17. The axle 18 is mounted on the intermediate member 14. As seen in FIGS. 7 and 8, slide 11 has a Z-shaped configuration as viewed in the direction of axle 18**.

The mounting plate 4 is provided with a guide member 22, which is situated on the inner side 21 of the frame 2. The guide member 22 is defined by webs 24, 25 defining therebetween a pocket or recess. Intermediate member 6 has an L-shaped profile including an arm 26 that protrudes into the pocket of guide member 22. The guide member 22 and the arm 26 guide the intermediate member 6 when it is moved horizontally parallel to the plane of the closed door 1, i.e. over the extent of slot 13*a*. The intermediate member is provided with an opening 27, the intermediate member 14 is provided with an opening 28 and the hinge arm 5 is provided with an opening 29. The openings 27 to 29 make it possible for the screw 10 which clamps the mounting plate 4 to the frame 2 to be tightened or loosened by means of a screw driver. The intermediate member 6 is provided with at least one hook 12 extending outwardly through opening 28 in intermediate member 14 and opening 29 in hinge arm 5. Further, the intermediate member 6 is provided with two holes in which positioning pins 8 of the intermediate member 14 project when the intermediate member 14 is mounted on the intermediate member 6.

When mounting the hinge, the mounting plate 4 which carries the intermediate member 6 is screwed to the frame 2 by means of the clamping screw 10. Separately, the hinge casing 3 on which the hinge arm 5 is mounted is fastened in a bore of the door 1. The intermediate member 14 is clamped to the hinge arm 5 by screw 9. When mounting the door 1 on the frame 2, the hinge arm 5 with the intermediate member 14 is placed on to the intermediate member 6 and the mounting plate 4. Thereby, the positioning pins 8 protrude into corresponding holes in the intermediate member 6. When mounting the hinge arm 5 on the mounting plate 4, the slide 11 is in the position shown in FIG. 7. In this position the hinge arm 5 can be placed onto the mounting plate 4 and can be removed therefrom. If the pivot lever 7 is pivoted counterclockwise, the slide 11 is moved to the right (with respect to FIG. 7) and engages as shown in FIG. 4 under the hook 12. In thins way the hinge arm 5 is locked on the mounting plate 4. In the illustrated embodiment, the pivoting of the pivot lever 7 is effected by means of the spring 17 which urges the pivot lever 7 to pivot counterclockwise.

Adjustment of the position of the hinge arm 5 in the direction of the height of the piece of furniture is possible by a loosening the clamping screw 10. When the clamping screw 10 is loosened, the mounting plate 4 can be moved longitudinally over the length of the slot 19 in the mounting plate 4. Loosening of the clamping screw 9 allows moving the hinge arm 5 horizontally in the direction of the depth of the piece of furniture over the length of slot 20 in hinge arm 5. Loosening of the clamping screw 13 makes possible longitudinal movement of the hinge arm 5 in a horizontal direction parallel the plane of the closed door 1 over the length of slot 13*a* in intermediate member 6.

Figure 2:
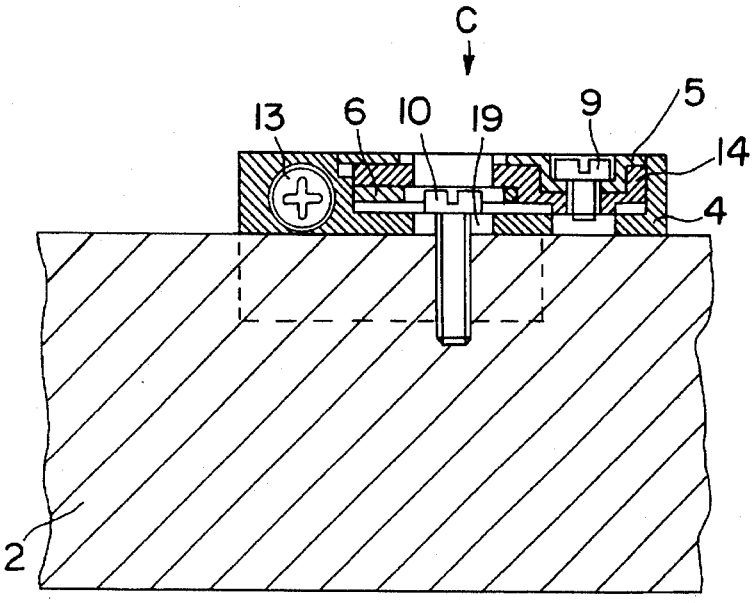
FIG. 2 is a sectional view along line II—II of FIG. 1.
Figure 1:
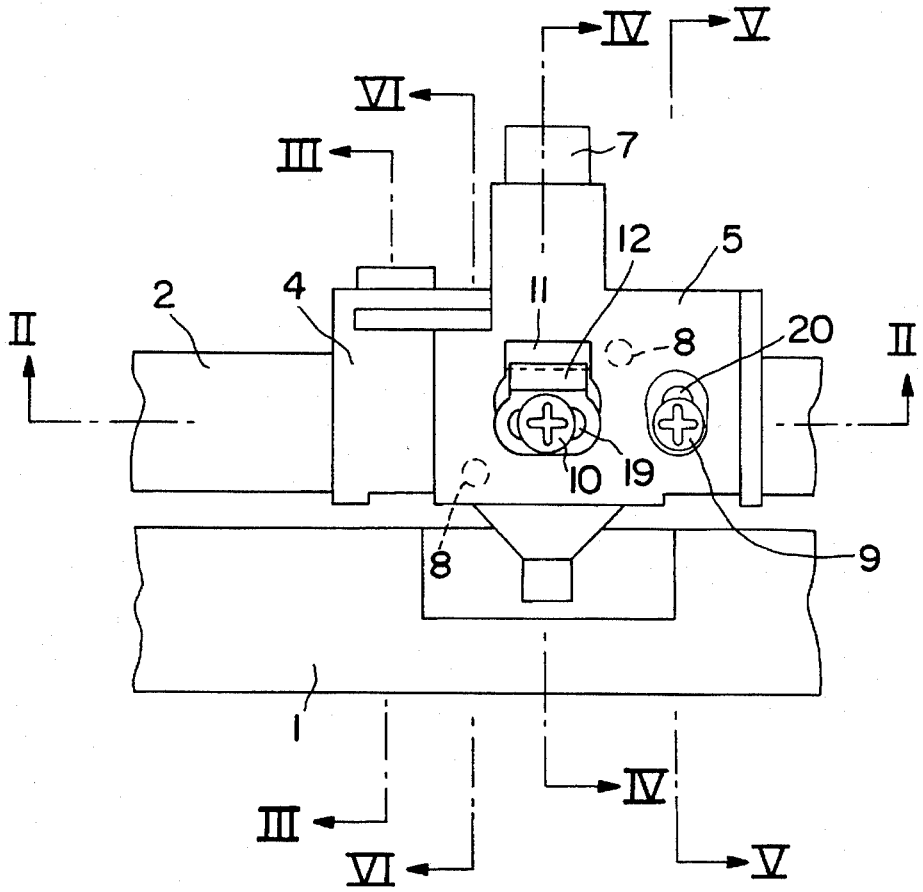
FIG. 1 is a schematic top view of a hinge arm and a mounting plate.
Figure 3:
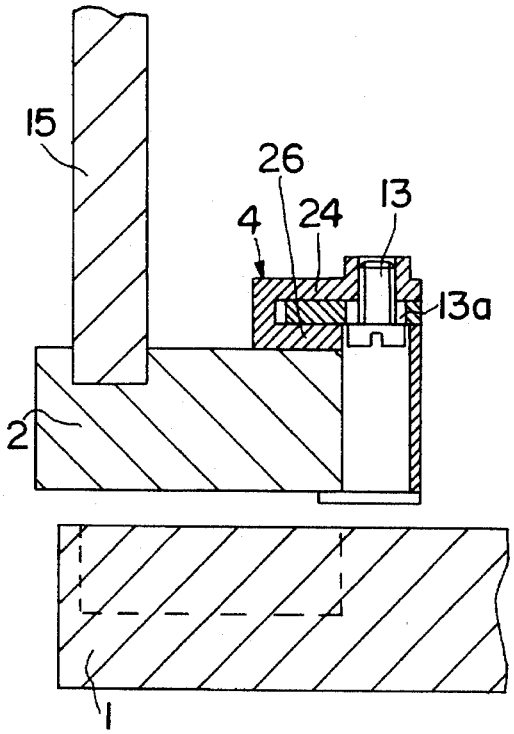
FIG. 3 is a sectional view along line III—III of FIG. 1.
Figure 5:
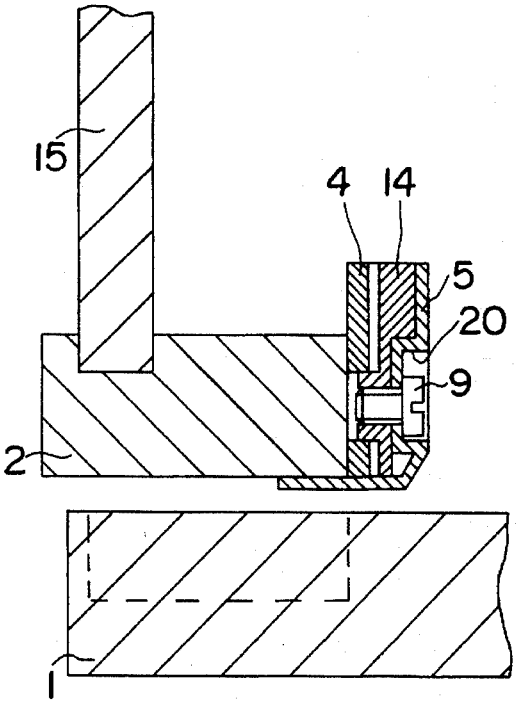
FIG. 5 is a sectional view along line V—V of FIG. 1.

The clamping screw 13 and the clamping screw 9 are situated on opposite sides of a plane which is perpendicular to the hinge axle 16 and which divides the hinge casing 3 into two equal parts. This arrangement helps to increase the stability of the hinge. This plane corresponds to section line IV—IV of FIG. 1.

We claim:

1. A mounting plate assembly of a hinge for mounting a furniture door to a furniture frame, said assembly comprising:

a mounting plate to be mounted on the frame by a screw;

a first intermediate member mounted on said mounting plate by a first clamping screw for longitudinal movement relative to said mounting plate in a first direction to be horizontal and to be parallel to the plane of the door when the door is mounted on the frame and in a closed position relative thereto;

said mounting plate including a guide member to be abutted against an inner side of the frame, and said first intermediate member including an arm guided by said guide member for movement relative thereto in said first direction;

a hinge arm pivotally connected to a hinge casing to be mounted on the door;

a second intermediate member mounted on said hinge arm by a second clamping screw for longitudinal movement of said hinge arm relative to said second intermediate member in a second direction to be horizontal and to be perpendicular to the plane of the door when the door is mounted on the frame and in the closed position relative thereto; and said second intermediate member being removably interlockably mountable on said first intermediate member.

2. An assembly as claimed in claim 1, further comprising a slide member slidably mounted on said second intermediate member and lockable with said first intermediate member.

3. An assembly as claimed in claim 2, wherein said first intermediate member has a hook, and said slide member is slidable under said hook to lock said second intermediate member to said first intermediate member.

4. An assembly as claimed in claim 2, further comprising a pivot lever pivotally mounted operable to slide said slide member to a position locking said second intermediate member on said first intermediate member.

5. An assembly as claimed in claim 4, further comprising a spring acting on said pivot lever to urge said slide member to said position.

6. An assembly as claimed in claim 4, wherein said slide member has a Z-shaped configuration as viewed in the direction of an axis of pivoting of said pivot lever.

7. An assembly as claimed in claim 4, wherein said pivot lever is pivotally mounted on said second intermediate member.

8. An assembly as claimed in claim 1, wherein said first intermediate member has an L-shaped configuration.

9. An assembly as claimed in claim 1, wherein said first clamping screw is threaded into a wall of said guide member.

10. An assembly as claimed in claim 1, wherein one of said intermediate members has at least two positioning pins fitting into corresponding holes in the other of said intermediate members.

11. An assembly as claimed in claim 1, wherein said first and second clamping screws are located on opposite sides of a plane that is perpendicular to an axis of pivoting of said hinge arm relative to said hinge casing and that divides said hinge casing into two equal halves.

* * * * *